US005664667A

United States Patent [19]

Kenmochi

[11] Patent Number: 5,664,667

[45] Date of Patent: Sep. 9, 1997

[54] PUSHBUTTON SWITCH

[75] Inventor: Yoshio Kenmochi, Ichihara, Japan

[73] Assignee: Sunarrow Co., Ltd., Japan

[21] Appl. No.: 683,771

[22] Filed: Jul. 17, 1996

Related U.S. Application Data

[62] Division of Ser. No. 567,223, Dec. 5, 1995.

[51] Int. Cl.[6] ..... H01H 9/00

[52] U.S. Cl. ..... 200/314; 200/305; 200/313; 200/512

[58] Field of Search ..... 200/512, 305, 200/304, 314, 313, 516, 513, 514, 310

[56] References Cited

U.S. PATENT DOCUMENTS 5,513,078 4/1996 Komrska et al. ..... 200/305

*Primary Examiner*—David J. Walczak

*Attorney, Agent, or Firm*—Hedman, Gibson & Costigan, P.C.

[57] ABSTRACT

A pushbutton switch is described which has a printed wiring board and a keypad arranged above the printed board, wherein the keypad has a non-working portion and a working portion made of translucent silicone rubber or thermoplastic elastomer in which the upper surfaces of the non-working portions only are covered with an opaque film, with an underside surface thereof covered by an insulating resin film so as to form an electrically conductive light-reflecting layer which is grounded to an earth portion.

2 Claims, 4 Drawing Sheets

PUSHBUTTON SWITCH

This is a divisional, of application Ser. No. 08/567,223, filed Dec. 5, 1995.

BACKGROUND OF THE INVENTION

1. Field of the Invention

The present invention relates to a pushbutton switch which has excellent electrical characteristics and which is convenient to use at night or in dark places when used as a terminal switch in electronic notebooks or in various portable communication devices such as cellular phones, car phones and the like.

Further, the present invention relates to a pushbutton switch which makes it possible for the wiring and the like inside the terminal device to be sufficiently protected against electromagnetic interference (EMI) from the outside as well as making it possible to prevent the occurrence of electrostatic discharge (ESD) in the printed wiring and the like due to the buildup of a high voltage electrostatic charge.

2. Description of the Prior Art

In one example of a prior art pushbutton switch, a printed-wiring board, which is equipped with a power source such as a light-emitting diode or the like, is provided with a keypad constructed from a flat non-working portion made from translucent silicone rubber, a bulging thin-walled skirt portion provided above the non-working portion, and a working portion supported by an upper part of the skirt portion. In this construction, the upper surface of the keypad, excluding the working portion there of, is covered by a white-colored film made from synthetic resin, with the upper surface of such synthetic resin film being formed into a black-colored printed membrane.

Further, in a dome style switch, a dome portion which rises in the shape of a dome is formed from metal, with the periphery of the dome portion being held in a fixed state by an adhesive film for fixing the dome portion. In this construction, when the dome portion is lowered, the upper electrode film positioned directly below the dome portion comes into contact with the lower electrode provided on the printed-wiring board.

Now, when the pushbutton switch according to the first example described above is used as an illuminated switch, the light emitted from the light source passes through the upper surface of the working portion to illuminate the numbers, letters, characters and other such symbols displayed on the working portion without any of such light leaking to the outside through the respective sides of the non-working portion, skirt portion and working portion. At this time, even though the surface of the white-colored synthetic resin film reflects the light emitted by the light source, a portion of such emitted light will be absorbed into the inside of the film, resulting in an insufficient reflectance. Accordingly, it becomes necessary for the number of light sources to be the same or nearly the same as the number of keys, and because the light-emitting diodes and the like that make up such light sources are expensive, the overall cost of the pushbutton switch becomes quite high.

Furthermore, when the keys of such prior art pushbutton switch are pressed with a finger, the presence of a high voltage electrostatic charge, for example, on the finger of an operator can cause an electrostatic discharge (ESD) in the printed-wiring board and the like.

Moreover, the effect of outside electromagnetic interference (EMI) on the wiring within the terminal device can give rise to electrical disturbances within the circuit and can cause the electrical characteristics of the device to deteriorate. In this regard, the prior art pushbutton switch described above is not sufficiently shielded against such electromagnetic interference.

Further, in the prior art dome switch described above because only the dome portion is made of metal and the dome portion supporting member is made from an insulating synthetic resin film, the effect of outside electromagnetic interference (EMI) on the wiring and the like inside the terminal device can result in an adverse effect on the electrical characteristics of the device, and it is also possible for an electrostatic discharge to occur in the printed wiring and the like due to a buildup of a high voltage electrostatic charge.

SUMMARY OF THE INVENTION

With a view toward overcoming the problems of the prior art described above, it is an object of the present invention to provide a pushbutton switch having a high reflectance and a reduced number of light sources mounted on the printed-wiring board. It is a further object of the present invention to provide a pushbutton switch which is highly resistant to ESD and EMI.

In a first embodiment of the present invention, the pushbutton switch includes a printed-wiring board equipped with a light source and provided with a keypad which is arranged above the printed-wiring board and which is comprised of a non-working portion and a working portion made of translucent silicone rubber or a thermoplastic elastomer, in which the upper surface of the non-working portion, excluding the working portion of the keypad, is covered with an opaque film, with the underside surface thereof being covered by an insulating resin film which forms an electrically conductive light-reflecting layer, and in which the electrically conductive light-reflecting layer is grounded by being connected to an earth portion.

In another embodiment of the present invention, the pushbutton switch includes a printed-wiring board equipped with a light source and provided with a keypad which is arranged above the printed-wiring board and which is comprised of a non-working portion and a working portion made of translucent silicone rubber or a thermoplastic elastomer, in which the upper surface of the non-working portion, excluding the working portion of the keypad, is covered with an opaque film, with the underside surface thereof being covered by an insulating resin film which forms an electrically conductive light-reflecting layer, and in which the electrically conductive light-reflecting layer is grounded by being connected to an earth portion. Further, a plastic dome sheet having a dome portion which rises in a dome shape at a position corresponding to the working portion is provided between the printed-wiring board and the keypad. Further, an electrically conductive light-reflecting layer is formed over the entire upper surface of the dome sheet, with the electrically conductive light-reflecting layer being grounded by being connected to an earth portion.

In another embodiment of the present invention, the pushbutton switch includes a printed-wiring board equipped with a light source and provided with a keypad which is arranged above the printed-wiring board and which is comprised of a non-working portion and a working portion made of translucent silicone rubber or a thermoplastic elastomer. Further, a metal dome sheet having a dome portion which rises in a dome shape at a position corresponding to the working portion is provided between the printed-wiring board and the keypad via a spacer made of insulating resin, with the metal dome sheet being grounded by being connected to an earth portion.

In another embodiment of the present invention, the pushbutton switch includes a printed-wiring board equipped with a light source and provided with a keypad which is arranged above the printed-wiring board and which is comprised of a non-working portion and a working portion made of translucent silicone rubber or a thermoplastic elastomer, in which the upper surface of the non-working portion, excluding the working portion of the keypad, is covered with an opaque film, with the underside surface thereof being covered by an insulating resin film which forms an electrically conductive light-reflecting layer, and in which the electrically conductive light-reflecting layer is grounded by being connected to an earth portion. Further, a metal dome sheet having a dome portion which rises in a dome shape at a position corresponding to the working portion is provided between the printed-wiring board and the keypad, with the metal dome sheet being grounded by being connected to an earth portion.

DETAILED DESCRIPTION OF THE PREFERRED EMBODIMENTS

With reference to the appended drawings, a detailed description of a first embodiment according to the present invention will be given below.

Figure 1:
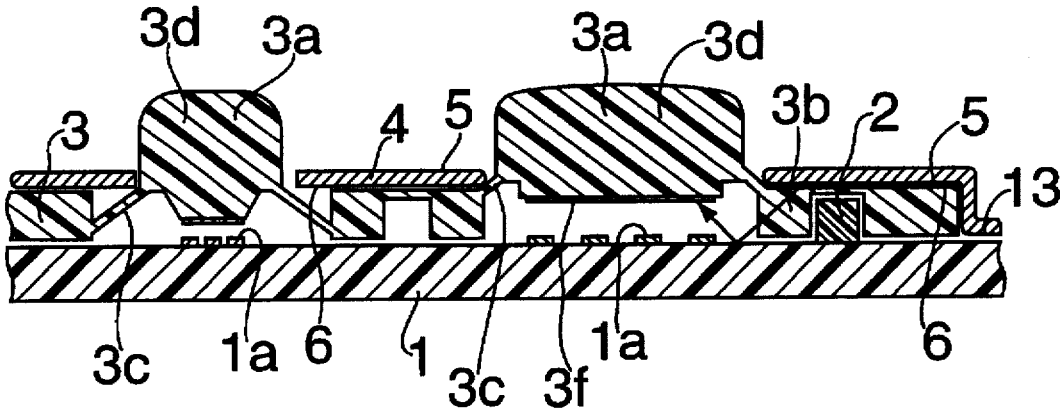
FIG. 1 is an enlarged cross-sectional schematic view of a first embodiment according to the present invention.
Figure 2:
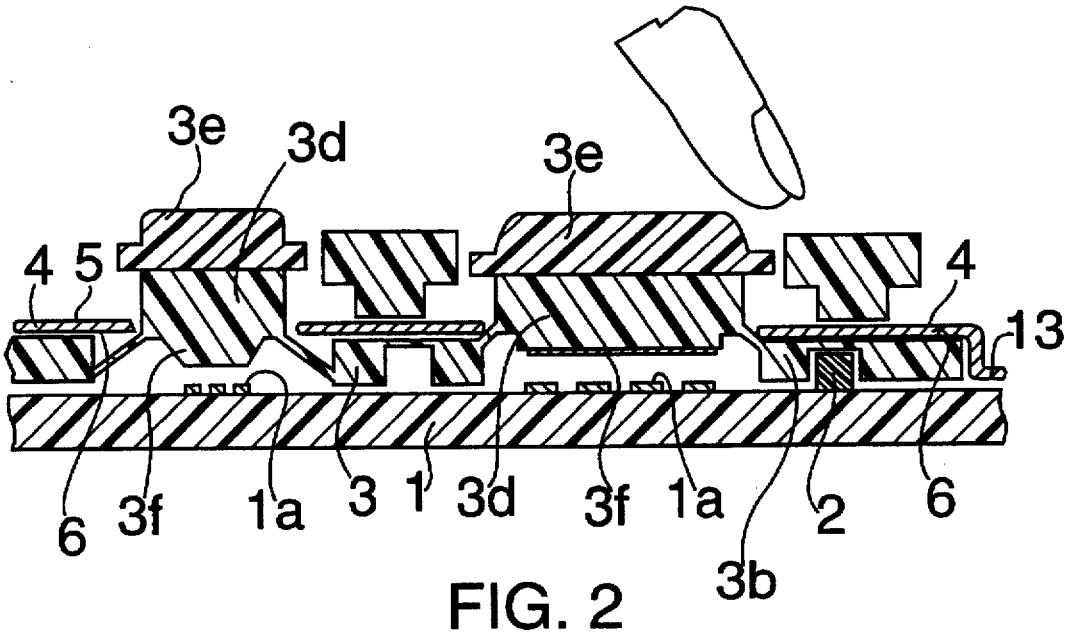
FIG. 2 is an enlarged cross-sectional schematic view of another embodiment according to the present invention.

Namely, a printed-wiring board 1 is provided with a printed wiring, and a light source 2 comprised of light emitting diodes (LED) or the like is mounted on the printed-wiring board 1. Further, a translucent keypad 3 is provided on the printed-wiring board 1. The keypad 3 is comprised of working portions **3*a* and non-working portions 3*b* integrally formed from translucent silicone rubber or one of various thermoplastic elastomers such as vinyl chloride elastomer, polyolefine elastomer, polystyrene-polybutadiene copolymerized thermoplastic elastomer, and ethylene vinyl acetate elastomer. As shown in FIG. 1, the working portions 3*a* comprise thin-walled skirt portions 3*c*, which slant in an upward direction from the side surface of the non-working portions 3*b*, and keytops 3*d* which are integrally formed with and supported by upper portions of the skirt portions 3*c*. In this connection, it is possible to further provide hard resin keytops 3*e* which can be fixed to the tips of the keytops 3*d*. Further, in a separate construction of the working portion 3*a*, the skirt portions 3*c* are eliminated and for the keytops 3*d* to be supported instead by thin-walled portions (not shown in the drawings) provided so as to protrude away from the side surfaces of the non-working portions 3*b*. Now, in the case where skirt portions 3*c* are provided, as shown in FIGS. 1 and 2, it becomes possible for the skirt portions 3*c* to carry out a click action. Further, as shown in the drawings, a movable contact 3*f*** is provided.

As is further shown in the drawings, the upper surfaces of the non-working portions **3*b*, excluding the working portions 3*a* of the keypad 3, are covered with a film 4 made of insulating resin. For example, a polyethyl ene terephthalate film having a thickness of 50 μm–125 μm can be used for the film 4. Further, by means of black-color printing or the like, an opaque membrane 5 for blocking light is formed on the top surface of the film 4 in order to prevent light inside the device from leaking to the outside. Further, formed on the bottom surface of the film 4 is an electrically conductive light-reflecting layer 6 comprised of a metallic membrane or the like having a high reflectance, such as a vapor deposited aluminum membrane or the like. This electrically conductive light-reflecting layer 6 is grounded by being connected to an earth portion (not shown in the drawings) of the printed-wiring board 1 or to some other suitable lace for grounding the layer 6. In the present invention, because the light-reflecting layer 6 has a high reflectance, it is possible to reduce the number of light-emitting elements (i.e., the number of light-emitting diodes) needed for the light source 2. Furthermore, because the light-reflecting layer 6 is electrically conductive, any static charge entering the device from the outside, such as from the finger or the like of an operator pushing a key, will be grounded by passing through the light-reflecting layer 6**, whereby it becomes possible to prevent an electrostatic discharge (ESD) from occurring within the printed-wiring or the like. Moreover this construction effectively shields the pushbutton switch from outside electromagnetic interference (EMI), and this makes it possible to obtain highly stable, excellent electrical characteristics.

Figure 4:
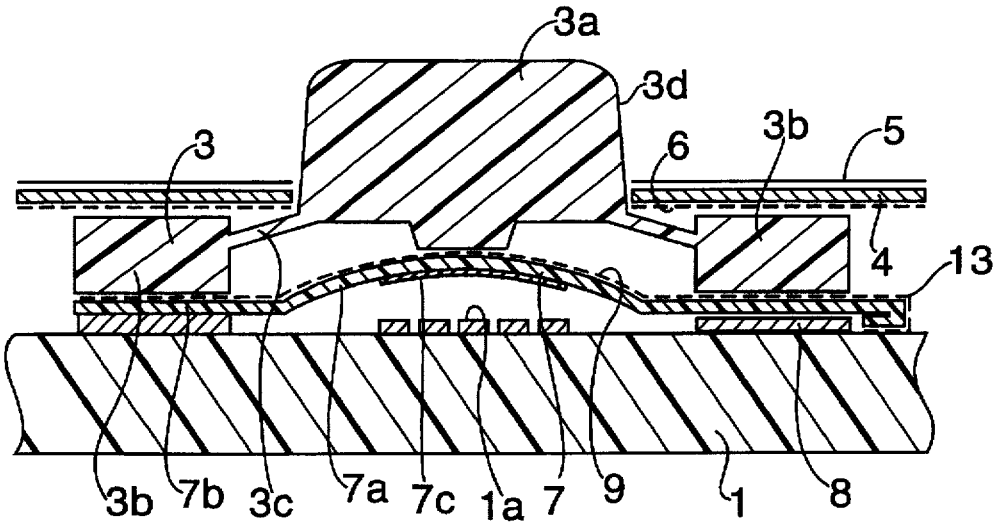
FIG. 4 is an enlarged cross-sectional schematic view of a first embodiment of a dome switch according to the present invention.
Figure 5:
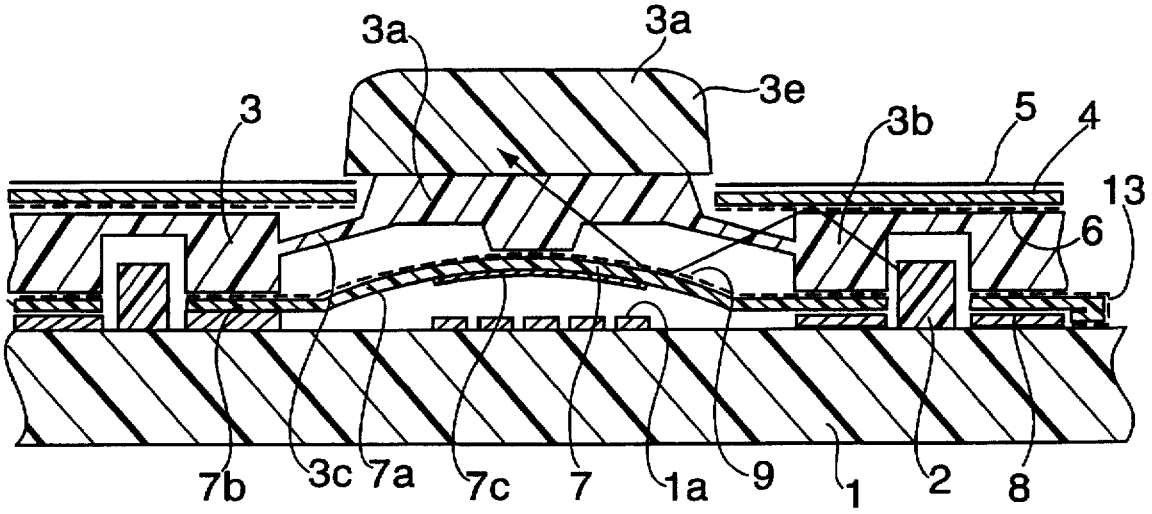
FIG. 5 is an enlarged cross-sectional schematic view of another embodiment of a dome switch according to the present invention.
Figure 6:
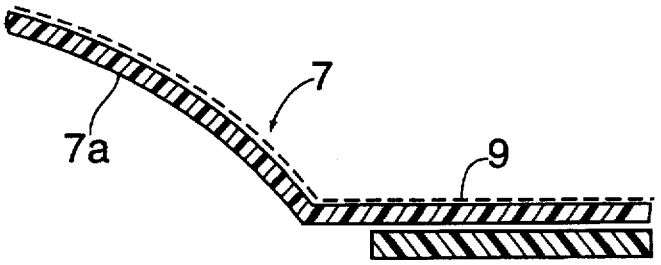
FIG. 6 is an enlarged cross-sectional schematic view of an electrically conductive light-reflecting layer formed from a plastic dome sheet.
Figure 7:
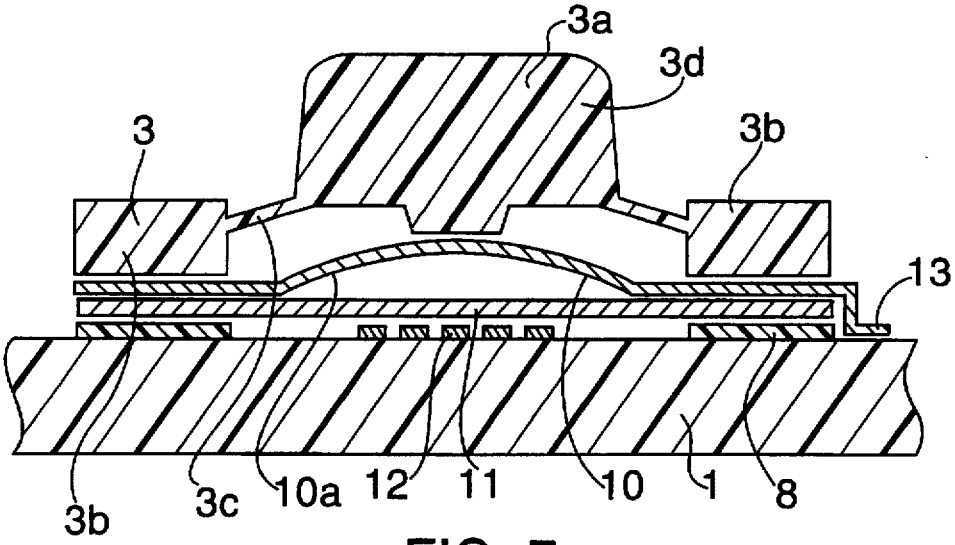
FIG. 7 is an enlarged cross-sectional schematic view of another embodiment of a dome switch according to the present invention, in which a metal dome sheet is used.
Figure 8:
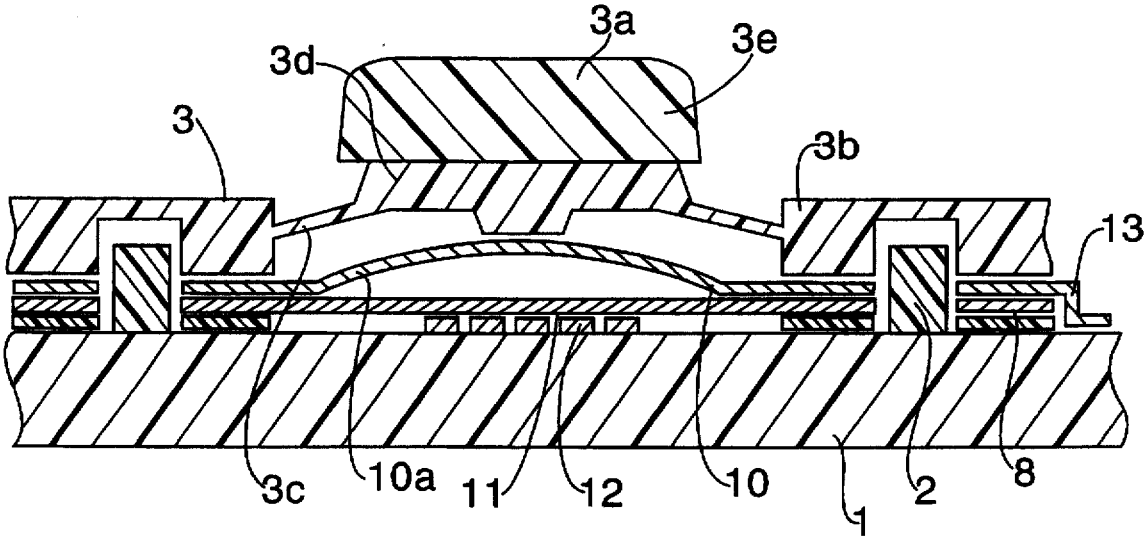
FIG. 8 is an enlarged cross-sectional schematic view of another embodiment of a dome switch according to the present invention, in which a metal dome sheet is used.
Figure 9:
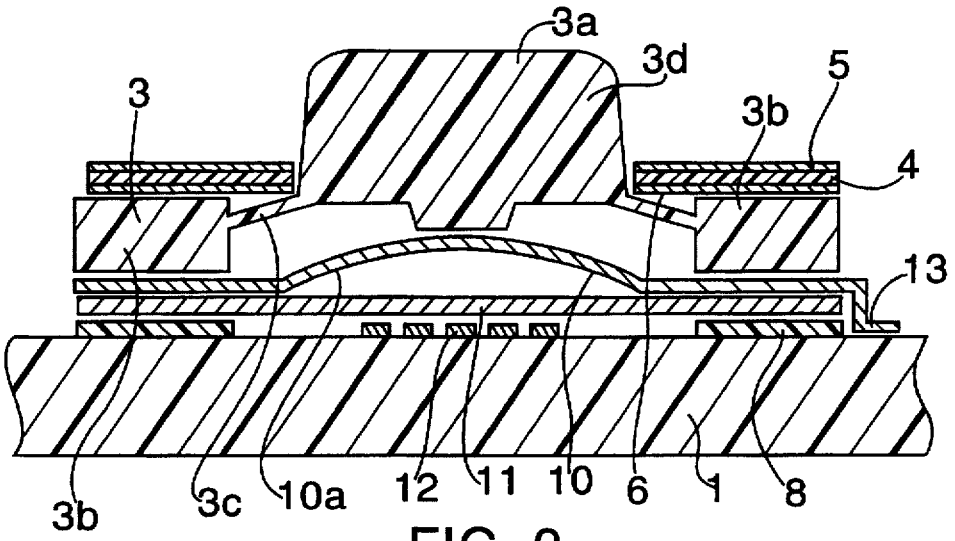
FIG. 9 is an enlarged cross-sectional schematic view of another embodiment of a dome switch according to the present invention, in which a metal dome sheet is used.
Figure 10:
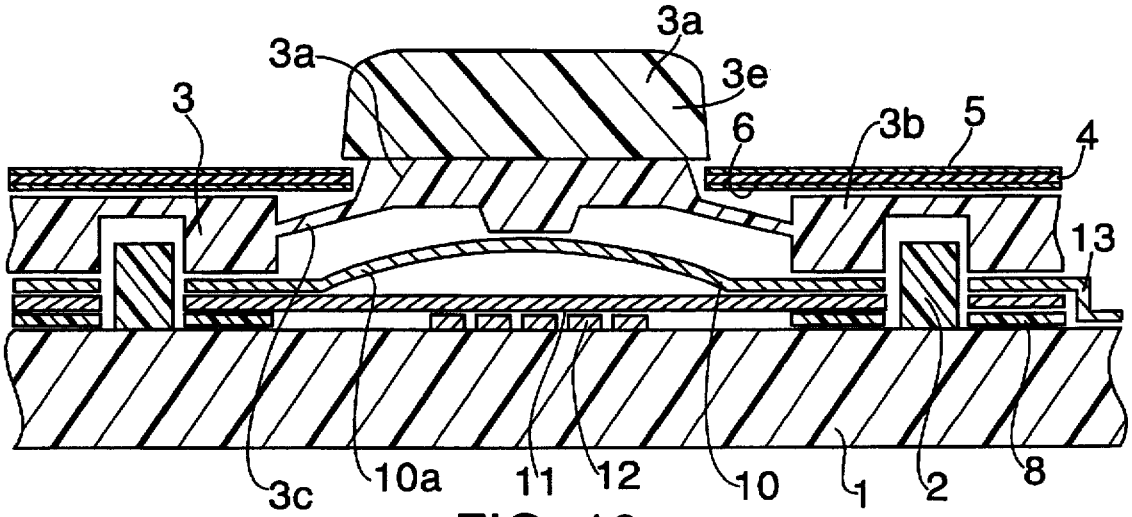
FIG. 10 is an enlarged cross-sectional schematic view of another embodiment of a dome switch according to the present invention, in which a metal dome sheet is used.
Figure 11:
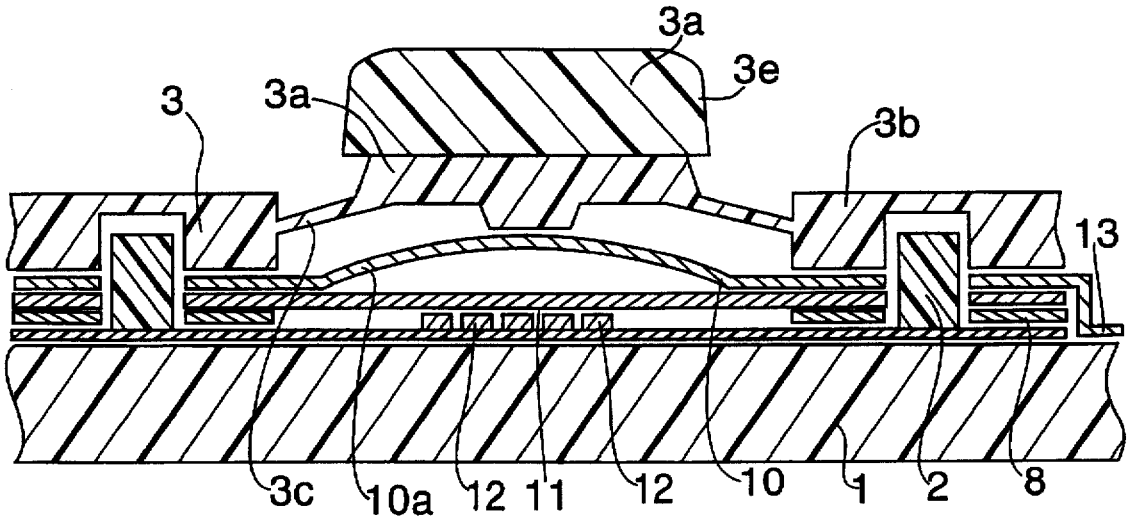
FIG. 11 is an enlarged cross-sectional schematic view of another embodiment of a dome switch according to the present invention, in which a metal dome sheet is used.

FIGS. 4–6 are cross-sectional schematic drawings showing the construction of another embodiment of a pushbutton switch which has a highly effective reflectance and excellent resistance to ESD and EMI, and which has excellent strength and stability characteristics.

Figure 3:
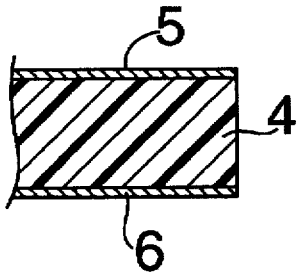
FIG. 3 is an enlarged cross-sectional schematic view of an electrically conductive light-reflecting layer formed from an insulating resin film.

In this embodiment, the basic structure is the same as that of the embodiments shown in FIGS. 1–3, however in the present embodiment the construction of the switch is suitable for that of a dome switch.

As shown in the drawings, a plastic dome sheet 7 is provided with a flat portion **7*b* and a rising dome portion 7*a* at a position which corresponds to the underside surface of the keytop 3*d* of the working portion 3*a*, and in the present embodiment a polyethylene terephthalate (PET) film having a thickness of 100 μm–125 μm is used. This plastic dome sheet 7 is arranged between the printed-wiring board 1 and the keypad 3, and, as shown in the drawings, an insulating resin sheet spacer 8 made of PET film or the like having a thickness of 50 μm–100 μm is provided below the bottom surface of the flat sheet portions 7***b*. Further, the stroke length between a fixed contact 1*a* on the printed-wiring board 1 and a movable contact 7*c* formed at the top portion of the underside surface of the dome portion 7*a* is set to be 0.4 mm–0.6 mm, for example.

Formed over the entire upper surface of the plastic dome sheet 7 is an electrically conductive light-reflecting layer 9 comprised of a metallic membrane or the like having a high reflectance, such as a vapor deposited aluminum membrane or the like. This electrically conductive light-reflecting layer 9 is grounded by being connected to an earth portion (not shown in the drawings) of the printed-wiring board 1 or to some other suitable place for grounding the layer 9. In this way, by being formed over the entire upper surface of the plastic dome sheet 7, the electrically conductive light-reflecting layer 9 works in cooperation with the electrically conductive light-reflecting layer 6 formed in the underside surface of the insulating resin film 4. With this arrangement, the light emitted from the light source 2 is reflected by the electrically conductive light-reflecting layer 6 of the insulating resin film 4 and then by the electrically conductive light-reflecting layer 9 of the dome portion 7*a*. At this point, because the light-reflecting layer 9 acts as a convex mirror, the light reflected therefrom converges in the direction toward the keytop 3*d*, and this results in an even better illuminance.

Accordingly, it becomes possible to achieve sufficient illumination with a light source 2 having fewer light-emitting diodes (LED). Furthermore, by providing reflective layers at two locations, namely, by forming the electrically conductive light-reflecting layers 6, 9 respectively on the underside surface of the insulating resin film 4 and the upper surface of the plastic dome sheet 7, the pushbutton switch becomes even more effectively resistant to ESD and EMI.

FIGS. 7–11 are cross-sectional schematic drawings showing the construction of a dome switch according to another embodiment of the present invention.

The basic difference between this embodiment and those described above lies in the provision of a metal dome sheet 10 having a dome portion 10*a* which rises in the shape of a dome at a position that corresponds to the working portion 3*a* of the above-described keypad 3. The metal dome sheet 10 is formed from a sheet of metal material, such as stainless steel, brass, cladding material, beryllium copper alloy or the like, which is cut to a prescribed length after undergoing a pressing process with a press machine to form the dome portion 10*a*.

As is shown in the drawings, an insulating resin sheet spacer 8 made of PET film is provided, with an upper electrode 11 being arranged between the metal dome sheet 10 and the spacer 8. This upper electrode 11 is formed from an electrically conductive material on the corresponding underside surface of an insulating resin sheet made of PET film. The corresponding lower electrode 12 is formed on the printed-wiring board.

Further, the lower electrode 12 may be formed above a flexible resin sheet provided on top of a reinforcing plate Further, in order to make the dome switch more effective, in addition to the provision of the above-described metal dome sheet 10, the printed-wiring board which is equipped with a light source is provided with a keypad which is arranged above the printed-wiring board and which is comprised of a non-working portion and a working portion made of translucent silicone rubber or a thermoplastic elastomer, in which the upper surfaces of the non-working portions 3*b*, excluding the working portions 3*a* of the keypad 3, are covered with an opaque film, with the underside surface thereof being covered by an insulating resin film which forms an electrically conductive light-reflecting layer, and in which the electrically conductive light-reflecting layer is grounded by being connected to an earth portion.

Now, in accordance with the structure of any of the above-described embodiments, because none of the light emitted from the light source is absorbed, namely, because virtually all the light emitted from the light source is reflected, such high reflectance in combination with the opaque membrane formed on the upper surface makes it possible to more effectively prevent light from leaking to the outside. Furthermore, because this results in an extremely high reflectance, it becomes possible to reduce the number of light-emitting elements (i.e., the number of light-emitting diodes) needed for the light source, which by itself makes it possible to produce the pushbutton switch at a lower cost. Further, because the electrically conductive light-reflecting layer is grounded to an earth portion, any static charge entering the device from the outside, such as from the finger or the like of an operator in contact with the keytop, will be grounded by passing through the light-reflecting layer, and this enables the pushbutton switch to be resistant to electrostatic discharge (ESD), whereby it becomes possible to maintain stable electrical characteristics. Moreover, because the electrically conductive light-reflecting layer acts as an electrical shield against various background electromagnetic interference (EMI), it becomes possible to prevent electromagnetic disturbances from arising in the printed wiring. Accordingly, the pushbutton switch according to the present invention is sufficiently resistant to EMI.

Furthermore, in comparison with prior art devices in which only the dome portion is made of metal with the rest of the dome supporting portion being made from an insulating synthetic resin film, in the dome switch according to the last embodiment above, by providing a metal dome sheet having a dome portion which rises at a position which corresponds to the working portion of the keypad, the pushbutton switch according to the present invention is much more effective at preventing electromagnetic interference (EMI) from affecting the wiring and the like, and this makes it possible to obtain highly stable, excellent electrical characteristics. Moreover, because the entire dome sheet is made of metal, even if a high voltage static charge enters the device from the outside, such as from the finger or the like of an operator, such static charge will be grounded by passing through the metal dome sheet, thereby preventing an electrostatic discharge (ESD) from occurring within the printed wiring and the like. Furthermore, because such metal dome sheets can be mass produced and are easy to install, the installation costs are relatively low.

What is claimed is:

1. A pushbutton switch, comprising:

a printed-wiring board equipped with a light source;

a keypad which is arranged above the printed-wiring board, the keypad including a non-working portion having an upper surface, an underside, and a working portion wherein both the working and non-working portions are made of translucent silicone rubber, in which said upper surface of the non-working portion, except for the working portion of the keypad, is covered with an opaque film, with an underside surface of said opaque film being covered by an insulating resin film which forms an electrically conductive light-reflecting layer, and in which the electrically conductive light-reflecting layer is grounded by being connected to an earth portion; and a plastic dome sheet arranged between the printed-wiring board and the keypad, the plastic dome sheet having a dome portion which rises in a dome shape at a position corresponding to the working portion;

in which an electrically conductive light-reflecting layer is formed over the entire upper surface of the dome sheet, with the electrically conductive light-reflecting layer being grounded by being connected to an earth portion.

2. A pushbutton switch, comprising:

a printed-wiring board equipped with a light source;

a keypad which is arranged above the printed-wiring board, the keypad including a non-working portion having an upper surface and an underside, and a working portion wherein both the working and non-working portions are made of a thermoplastic elastomer, in which said upper surface of the non-working portion, except for the working portion of the keypad, is covered with an opaque film, with an underside surface of said opaque film being covered by an insulating resin film which forms an electrically conductive light-reflecting layer, and in which the electrically conductive light-reflecting layer is grounded by being connected to an earth portion; and a plastic dome sheet arranged between the printed-wiring board and the keypad, the plastic dome sheet having a dome portion which rises in a dome shape at a position corresponding to the working portion;

in which an electrically conductive light-reflecting layer is formed over the entire upper surface of the dome sheet, with the electrically conductive light-reflecting layer being grounded by being connected to an earth portion.

* * * * *